United States Patent [19]

Hancock

[11] 4,315,296

[45] Feb. 9, 1982

[54] RELIABLE OVER-TEMPERATURE CONTROL CIRCUIT

[75] Inventor: Geoffrey Hancock, Simi Valley, Calif.

[73] Assignee: Semco Instruments, Inc., North Hollywood, Calif.

[21] Appl. No.: 197,008

[22] Filed: Oct. 14, 1980

[51] Int. Cl.[3] ..... H02H 5/04

[52] U.S. Cl. ..... 361/103; 60/39.28 T; 307/360; 340/588

[58] Field of Search ..... 361/103, 106, 25, 27, 361/95, 96; 340/588; 307/360, 361, 234; 73/346; 60/39.28 T

[56] References Cited

U.S. PATENT DOCUMENTS

| | | | |
|---|---|---|---|
| 3,931,619 | 1/1976 | Moore et al. | 340/588 X |
| 4,115,998 | 9/1978 | Gilbert et al. | 60/39.28 T X |
| 4,148,086 | 4/1979 | Landa et al. | 340/588 X |

*Primary Examiner*—J. D. Miller
*Assistant Examiner*—Reinhard J. Eisenzopf
*Attorney, Agent, or Firm*—Poms, Smith, Lande & Rose

[57] ABSTRACT

A turbine engine over-temperature shut-off control circuit includes a series of separate timing circuits and output control signal generation gates. A corresponding set of temperature set-point triggering comparator circuits apply energization signals to their associated timing circuits and gates, to define a temperature vs. time envelope, which turns the turbine off when the turbine has been at a predetermined dangerously high temperature for more than a predetermined length of time.

6 Claims, 3 Drawing Figures

RELIABLE OVER-TEMPERATURE CONTROL CIRCUIT

FIELD OF THE INVENTION

This invention relates to safety, shut-off control circuits for turbine engines.

BACKGROUND OF THE INVENTION

Gas turbine engines are becoming more widely used, for example, in fire-fighting and other equipment where the public may be in physical proximity to the engine. Accordingly, the public liability factor has focused increased attention on the rare catastrophic failures of turbine engines, usually resulting from overheating, and on over-temperature protective circuits to prevent such accidents.

The manufacturers of gas turbine engines have determined the maximum time periods that the engines can withstand over-temperatures at certain specified temperature levels. Over-temperature control circuits which have been proposed heretofore, have included derivative temperature monitoring circuits which utilized thermocouple signals. These circuits involved charge derived signals and were very susceptible to electromagnetic interference (EMI). Accordingly, they were not well suited to engine environments.

It is therefore a principal object of the invention to provide a simple and more reliable turbine over-temperature protection circuit, and one which is compatible with present-day technology.

SUMMARY OF THE INVENTION

In accordance with the present invention, a turbine engine over-temperature shut-off control circuit includes a series of separate timing circuits and output control signal generation gates connected to receive output signals from the timers. A corresponding set of temperature set-point triggering comparator circuits receives an input signal indicating the turbine temperature, and they each apply energization signals to their associated timing circuits and enabling signals to the gates. This circuitry serves to define a temperature vs. time envelope, which turns the turbine off when the turbine has been at a predetermined dangerously high temperature for more than a predetermined length of time.

Advantages of the circuit include the use of standard solid state chips which are highly resistant to EMI, and which have low cost and a high degree of reliability. Further, it has been determined that this type of digitized circuitry provides a more reliable and effective shut-off circuit than the charge controlled integrating circuits previously employed.

Other objects, features, and advantages of the present invention will become apparent from a consideration of the following detailed description, and from the accompanying drawings.

DETAILED DESCRIPTION

Figure 1:
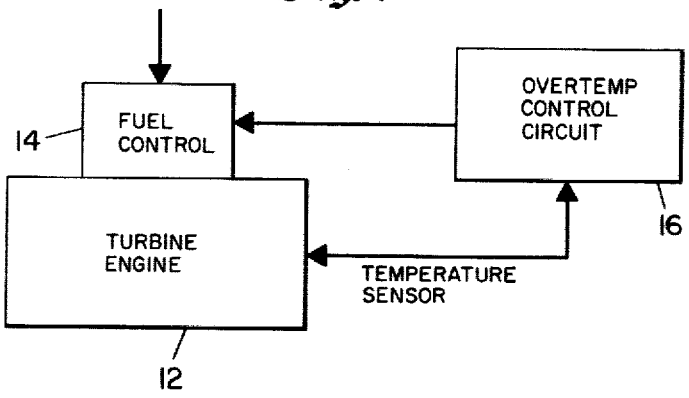
FIG. 1 is an over-all block diagram of a system utilizing the present invention.

Referring more particularly to the drawings, FIG. 1 is a block diagram showing a turbine engine 12 with fuel control arrangements 14, which are operated by a signal from the over-temperature control circuit 16 to shut off the engine.

Figure 2:
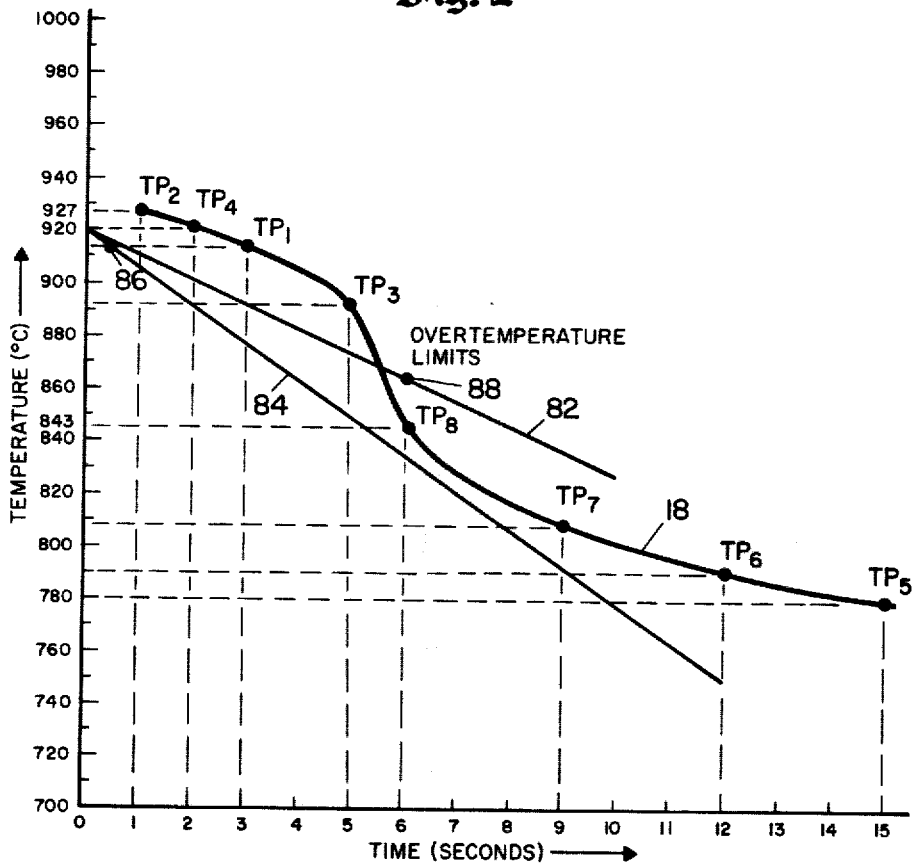
FIG. 2 is an over-temperature limits plot for a turbine engine.

FIG. 2 is a plot 18 of temperature vs. time showing an over-temperature vs. time plot for a particular turbine engine. Considering a particular temperature point TP-8 on the plot 18, it indicates that the engine may not be operated for more than six seconds at a temperature equal to or above 843 degrees Centigrade. Similarly, the points TP-2 and TP-5 indicate that the turbine engine may not be operated for more than one second at a temperature of 927 degrees Centigrade or above, or at a temperature of 780 degrees Centigrade or above for more than 15 seconds. The two end points TP-2 and TP-5 as well as the central point TP-8 were provided by design specifications; and the Z-shaped configuration of characteristic plot 18 was developed as compatible with the horizontally asymptotic nature of the curve at the temperature level of TP-5.

Consideration will now be given to the digitization circuit of FIG. 3, and we will then return to the operation of the circuit in connection with the characteristic of FIG. 2.

Figure 3:
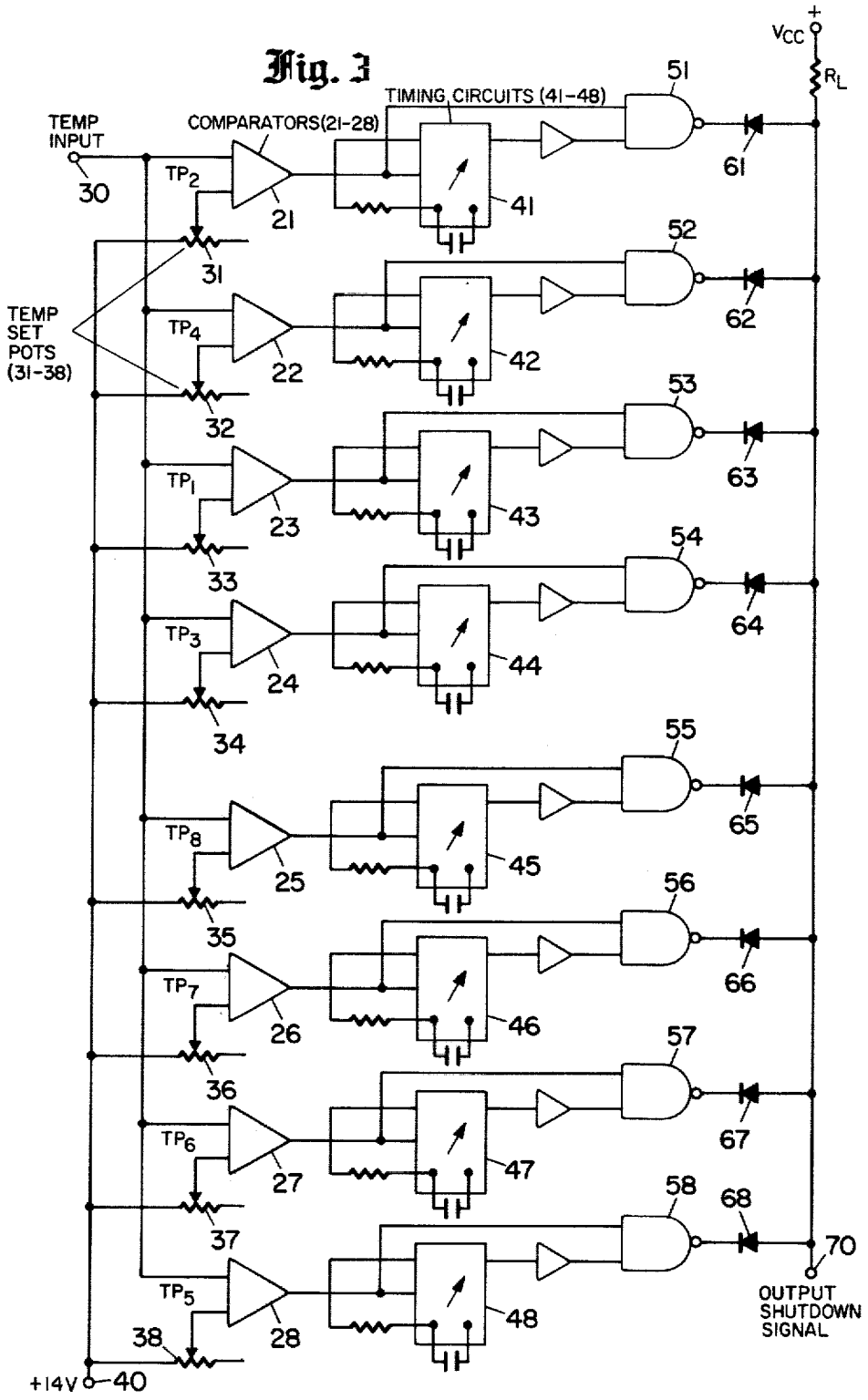
FIG. 3 is a logic circuit diagram illustrating the principles of the present invention.

In FIG. 3 a series of comparator circuits 21 through 28 are provided, with each having one input connected to the temperature indication voltage lead 30, and the other input lead connected via set-point potentiometers 31 through 38 respectively, to a reference voltage 40. Each of the comparator circuits 21 through 28 will trigger to an ON state when the temperature input signal from lead 30 exceeds the reference potential provided by the set-point potentiometers.

The output from comparator circuit 21 is supplied both to the timing circuit 41 and to the "NAND" logic circuit 51. Accordingly, when the temperature signal from the input lead 30 exceeds the reference voltage provided by potentiometer 31, a signal will be applied both to a timing circuit 41 and to the "NAND" circuit 51. A NAND circuit requires inputs at both of its two input circuits in order to provide an output signal. Incidentally, a "NAND" circuit is similar to an "AND" circuit, with the exception that it has an inverted output signal. If the temperature stays above the triggering level, for the duration required to provide an output signal from timing circuit 41, both of the input leads to the NAND circuit 51 are energized, and an output signal will be transmitted through the isolation diode 61 to the output lead 70 to shut down the turbine engine. Of course, if the temperature drops below the triggering level for the comparator 21 before an output signal is provided from the timer 41, one of the inputs to the NAND circuit 51 is withdrawn, and no output signal occurs.

The remaining timing circuits 42 through 48, NAND circuits 52 through 58, and their associated output diodes 62 through 68 form similar logic circuit arrangements for the other temperature set points as shown in FIG. 2. Of course, each of the potentiometer and timing circuits is individually adjustable to define the desired envelope of the type shown in FIG. 2, which may of course vary for different turbine engines.

Now, one dangerous time for the overheating of turbine engines is the start-up interval. Cooling is relatively low, and particularly if there has been a prior shutdown without a sufficient cooling-off period, the engine may overheat. Also, if the associated storage battery which may initially drive the compressor is weak or discharged, there by be insufficient initial cooling. In practice, the temperature may initially rise rapidly by as much as 300 degrees Centigrade per second. Accordingly, with reference to the circuit of FIG. 3 there may be a complex pattern of successive energizations of the comparators associated with successive temperature check points, with various of the timing circuits being in different stages of operation.

For simplicity and for ease of understanding, however, in returning to a consideration of FIG. 2, the two straight lines 82 and 84 will be considered on the basis of an initial temperature of 920 degrees C. when the circuit is put into operation, and a declining temperature as indicated by the downward slope of lines 82 and 84. Initially, under these extremely hypothetical circumstances, all of the lower temperature check points would be energized, and the associated comparator-triggering circuits and timing circuits would be operative.

Considering the more rapidly dropping temperature characteristic 84, first, it may be noted that, after about one-half second the temperature will have dropped to point 86 below 913 degrees C., the approximate temperature of TP-1. Accordingly, one input to the NAND gate 53 will be disabled, thus precluding any output from this circuit. Similarly, as time passes, before the timing circuits produce an output signal, the temperature has dropped below the critical level, so that one of the necessary inputs to each NAND circuit is missing, and the engine shut-off circuit is not actuated.

Incidentally, it may be noted that the temperature points as shown in FIG. 2 do not run sequentially from TP-1 at the highest temperature down to TP-8 at the lower temperature. Instead, they have been selected somewhat arbitrarily as they were actually constructed. However, in FIG. 3, for convenience, the circuits have been designated from top to bottom in order of their temperature set points, and they accordingly correspond to the sequence of the temperature points shown in FIG. 2 from the highest to the lowest temperature.

Now, referring to the slower temperature drop-off illustrated by plot 82, the timing circuits associated with the first four higher temperature points do not permit the energization of the associated NAND gates. However, in connection with TP-8, involving the comparator 25 and the timer circuit 45, it may be noted that point 88 indicates a temperature of approximately 860 degrees C., as compared with the triggering point of approximately 843 degrees for comparator 25 associated with TP-8. Accordingly, both of the two inputs to the NAND circuit 55 will be energized after six seconds, and the shutoff control signal provided to lead 70 will be operative to turn off the turbine engine.

Incidentially, it is again emphasized that the two straight line characteristics 82 and 84 are merely exemplary and have been considered in order to give a qualitative feel for the operation of the circuit. In practice, as noted above, there may be an initial rapid build-up of temperature for one reason or another, and then, as the compressor starts to operate at a more efficient level, the temperature will drop rapidly to more acceptable levels.

It is again noted that, in connection with prior types of circuits which have been proposed, true integration circuits have been used with arrangements for weighting the integrated charge in accordance with the jet engine temperature, as well as the time of the over-temperature interval. However, these circuits tended to become overly complex, and as noted above, were subject to malfunction as a result of EMI. On the other hand, the present digital circuitry using standard logic circuits, avoids the sensitivity problems, and provides a high degree of reliability. Also, in the event of possible failure of one of the circuits, the other circuits provide a further measure of reliability by turning the turbine engine off after a slightly longer period of time. Incidentally, it may be noted that the logic circuits as shown in FIG. 3 may be implemented by standard C-MOS circuits. The timers 41 through 48 may be implemented by EXAR Part No. 559, and the comparators and NAND gates may be implemented by any standard C-MOS circuitry.

In closing, it is to be understood that the foregoing detailed description and the drawings relate to one illustrative circuit for implementing the present invention. It could also be implemented through the use of other electronic circuits having equivalent logic functions, and including additional logic circuits, amplifiers, inverters, or signal regenerators to accomplish these functions. Accordingly, the present invention is not limited to that precisely as shown and described hereinabove.

What is claimed is:

1. A digitized over-temperature monitoring and shut-off circuit for turbine engines, comprising:

means for generating an electrical signal corresponding to the temperature of a turbine engine;

a plurality of comparator triggering circuits, each coupled to receive said electrical signal representing temperature, for producing an output signal when the temperature exceeds a preset level;

timing circuit means associated with each comparator triggering circuit for producing an output signal following a predetermined delay interval;

gate output circuit means for receiving input signals, respectively, from each of said comparator triggering circuits and from each said associated timing circuits and for producing an output signal when both signals are present; and an output control circuit for shutting off the turbine engine when a signal is received from any of said gate output circuits.

2. An over-temperature monitoring and shut-off circuit for turbine engines, as defined in claim 1 including means for varying the temperature set points of each of said comparator-triggering circuits.

3. An over-temperature monitoring and shut-off circuit for turbine engines as defined in claim 1 including means for varying the timing interval of each of said timing circuits.

4. An over-temperature monitoring and shut-off circuit for turbine engines as defined in claim 1, including means for varying the temperature set points of for each of said comparator-triggering circuits;

means for providing a series of different timing intervals for said timing circuits;

whereby said temperature set-points and said timing intervals may be set to define the desired time vs. temperature envelope, and increased reliability and protection against faults is provided by the parallel organization of the circuitry.

5. An over-temperature monitoring and shut-off circuit for turbine engines as defined in claim 1 wherein said circuit is a solid state digital circuit, and wherein said gate output circuit means is a NAND gate.

6. A digitized over-temperature monitoring and shut-off circuit for turbine engines, comprising:

means for generating an electrical signal corresponding to the temperature of a turbine engine;

a plurality of comparator triggering circuits, each coupled to receive said electrical signal representing temperature, for producing an output signal when the temperature exceeds a preset level;

timing circuit means associated with each comparator triggering circuit for producing an output signal following a predetermined delay interval;

gate output circuit means for receiving input signals, respectively, from each of said comparator triggering circuits and from each said associated timing circuits and for producing an output signal when both signals are present;

output control means connected to all of said gate means for shutting off the turbine engine when a signal is received from any of said gate output circuits;

means for providing a series of different temperature set-points;

for each of said comparator-triggering circuits;

means for providing a series of different timing intervals for said timing circuits;

whereby said temperature set-points and said timing intervals may be set to define the desired time vs. temperature envelope, and increased reliability and protection against faults is provided by the parallel organization of the circuitry.

* * * * *